US011459149B2

(12) United States Patent
Ueno et al.

(10) Patent No.: US 11,459,149 B2
(45) Date of Patent: Oct. 4, 2022

(54) STEEL SHEET FOR CROWN CAP, CROWN CAP AND METHOD FOR PRODUCING STEEL SHEET FOR CROWN CAP

(71) Applicant: JFE STEEL CORPORATION, Tokyo (JP)

(72) Inventors: Takashi Ueno, Tokyo (JP); Nobusuke Kariya, Tokyo (JP); Katsumi Kojima, Tokyo (JP); Yoshihide Yamamoto, Tokyo (JP); Akihiro Katagiri, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 370 days.

(21) Appl. No.: 16/631,539

(22) PCT Filed: Jul. 25, 2018

(86) PCT No.: PCT/JP2018/027994

§ 371 (c)(1),
(2) Date: Jan. 16, 2020

(87) PCT Pub. No.: WO2019/026738

PCT Pub. Date: Feb. 7, 2019

(65) Prior Publication Data

US 2020/0198844 A1 Jun. 25, 2020

(30) Foreign Application Priority Data

Jul. 31, 2017 (JP) ..... JP2017-148314

(51) Int. Cl.

| | |
|---|---|
| ***B65D 41/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C21D 8/02*** | (2006.01) |
| ***C23G 1/00*** | (2006.01) |

(52) U.S. Cl.

CPC ..... *B65D 41/12* (2013.01); *C21D 8/0226* (2013.01); *C21D 8/0236* (2013.01); *C21D 8/0273* (2013.01); *C22C 38/001* (2013.01); *C22C 38/02* (2013.01); *C22C 38/04* (2013.01); *C22C 38/06* (2013.01); *C23G 1/00* (2013.01)

(58) Field of Classification Search

None

See application file for complete search history.

(56) References Cited

U.S. PATENT DOCUMENTS

| | | | |
|---|---|---|---|
| 2016/0362761 | A1 | 12/2016 | Hiraguchi et al. |
| 2017/0335438 | A1 | 11/2017 | Tanaka et al. |

FOREIGN PATENT DOCUMENTS

| | | | | | |
|---|---|---|---|---|---|
| JP | S50139013 | A | | 11/1975 | |
| JP | 2013019027 | A | * | 1/2013 | ..... C21D 8/0426 |
| JP | 2015151620 | A | * | 8/2015 | |
| JP | 2015151620 | A | | 8/2015 | |
| JP | 2015224384 | A | | 12/2015 | |
| JP | 6057023 | B2 | | 1/2017 | |
| WO | 2013008457 | A1 | | 1/2013 | |
| WO | 2015129191 | A1 | | 9/2015 | |
| WO | 2016084353 | A1 | | 6/2016 | |
| WO | 2016104773 | A1 | | 6/2016 | |

OTHER PUBLICATIONS

Oct. 23, 2018, International Search Report issued in the International Patent Application No. PCT/JP2018/027994.

Apr. 17, 2020, the Extended European Search Report issued by the European Patent Office in the corresponding European Patent Application No. 18840882.7.

* cited by examiner

*Primary Examiner* — Anthony M Liang

(74) *Attorney, Agent, or Firm* — Kenja IP Law PC

(57) ABSTRACT

A steel sheet for crown cap having excellent formability from which a crown cap having an excellent pressure resistance can be produced without an expensive soft liner even if the steel sheet is subjected to sheet metal thinning, the steel sheet having: a chemical composition containing, in mass %, C: more than 0.006% and 0.012% or less, Si: 0.02% or less, Mn: 0.10% or more and 0.60% or less, P: 0.020% or less, S: 0.020% or less, Al: 0.01% or more and 0.07% or less, and N: 0.0080% or more and 0.0200% or less, with the balance being Fe and inevitable impurities; and a percentage of a region of more than 0% and less than 20% at a position of ½ of a sheet thickness, the region having a dislocation density of $1\times10^{14}$ $m^{-2}$ or less.

7 Claims, 1 Drawing Sheet

STEEL SHEET FOR CROWN CAP, CROWN CAP AND METHOD FOR PRODUCING STEEL SHEET FOR CROWN CAP

TECHNICAL FIELD

This disclosure relates to a steel sheet for crown cap, in particular, a steel sheet for crown cap having excellent pressure resistance against internal pressure and used for beer bottles and the like.

Further, this disclosure relates to a crown cap made of the steel sheet for crown cap and a method for producing the steel sheet for crown cap.

BACKGROUND

Metal plugs referred to as crown caps are widely used for containers of beverages such as soft drinks and alcoholic drinks. Typically, a crown cap includes a thin steel sheet portion subjected to press forming and a resin liner portion. The thin steel sheet portion includes a disk-shaped portion which covers a bottle mouth and a pleated portion disposed in the periphery thereof. The resin liner is attached to the disk-shaped portion made of a thin steel sheet. The pleated portion is crimped around a bottle mouth to fill up a gap between the bottle mouth and the thin steel sheet with the liner, thus hermetically sealing the bottle.

Bottles filled with beer and carbonated beverages have internal pressure caused by the contents of the bottles. The crown cap is required to have a high pressure resistance so that, even when the internal pressure is increased because of a change in temperature or the like, the crown cap may not be deformed to break the sealing of the bottle, leading to the leakage of contents. For evaluation of the pressure resistance of a crown cap, for example, the crown cap is crimped to a bottle, air is injected from the top of the crown cap to increase the internal pressure in the bottle at a constant rate, and the pressure at which the crown cap is detached is measured. When the pressure at which the crown cap is detached is 140 psi (0.965 MPa) or more, the crown cap is judged as satisfactory.

Further, when the shapes of pleats of the crown cap are not uniform, the crown cap not only looks bad, reducing the consumer's willingness to purchase, but also may not provide sufficient sealability even if it is crimped to a bottle mouth. Therefore, a thin steel sheet used as a material of a crown cap is required to have excellent formability. For judgment of formability, for example, pass/fail is determined by visually checking the uniformity of the shapes of pleats.

A single reduced (SR) steel sheet is mainly used as a thin steel sheet that serves as a material of a crown cap. Such a SR steel sheet is produced by reducing the thickness of a steel sheet by cold rolling, and subsequently subjecting the steel sheet to annealing and temper rolling. A conventional steel sheet for crown cap generally has a sheet thickness of 0.22 mm or more, and a sufficient pressure resistance and formability have been capable of being ensured by the use of a SR material made of mild steel used for, for example, cans for foods or beverages.

In recent years, however, a sheet metal thinning has been increasingly required for steel sheets for crown cap, as with steel sheets for cans, for the purpose of cost reduction of crown caps. When the sheet thickness of a steel sheet for crown cap is 0.20 mm or less, a crown cap produced from a conventional SR material would have an insufficient pressure resistance. To ensure the pressure resistance, it is conceivable to use a double reduced (DR) steel sheet obtained by performing annealing and subsequent secondary cold rolling, taking advantage of work hardening to compensate for a reduction in strength due to sheet metal thinning, but a sufficient pressure resistance cannot be ensured by merely using a DR steel sheet.

Although the details of the mechanism of this phenomenon are uncertain, it is known that when a DR steel sheet having a sheet thickness of 0.20 mm or less is used as a steel sheet for crown cap, a softer material than a conventional one can be used as a material of a liner to thereby improve the pressure resistance. However, a liner made of a soft material is expensive than a liner made of a conventional hard material, and thus as a result, cost reduction cannot be achieved in a whole crown cap.

The techniques described below have been proposed to obtain a steel sheet for crown cap having an excellent pressure resistance.

JP 2015-224384 A (PTL 1) proposes a steel sheet for crown cap having excellent workability and having a chemical composition containing, in mass %, C: 0.0005% to 0.0050%, Si: 0.02% or less, Mn: 0.10% to 0.60%, P: 0.02% or less, S: 0.02% or less, Al: 0.01% to 0.10% or less, N: 0.0050% or less, and Nb: 0.010% to 0.050%, with a balance being Fe and inevitable impurities. Further, the steel sheet for crown cap has an average TS of 500 MPa or more, the average TS being an average value of the tensile strength (TS) in a rolling direction of the steel sheet and TS in the direction orthogonal to the rolling direction, and has an average yield strength (YP) and the average TS satisfying the relationship of average YP (MPa) 130+0.746×average TS (MPa), the average YP being an average value of YP in the rolling direction and YP in the direction orthogonal to the rolling direction.

WO 2015129191 A (PTL 2) proposes a steel sheet for crown cap having a composition containing, in mass %, C: 0.0005% to 0.0050%, Si: 0.02% or less, Mn: 0.10% to 0.60%, P: 0.020% or less, S: 0.020% or less, Al: 0.01% to 0.10% or less, N: 0.0050% or less, and Nb: 0.010% to 0.050%, with a balance being Fe and inevitable impurities, the steel sheet having a mean r value of 1.30 or more and YP of 450 MPa or more and 650 MPa or less.

JP 6057023 B (PTL 3) proposes a steel sheet for crown cap having a composition containing, in mass %, C: 0.0010% to 0.0060%, Si: 0.005% to 0.050%, Mn: 0.10% to 0.50%, Ti: 0% to 0.100%, Nb: 0% to 0.080%, B: 0% to 0.0080%, P: 0.040% or less, S: 0.040% or less, Al: 0.1000% or less, and N: 0.0100% or less, with a balance being Fe and inevitable impurities. The steel sheet for crown cap further has a minimum r value of 1.80 or more in a direction of 25° to 65° with respect to a rolling direction of the steel sheet, a mean r value of 1.70 or more in a direction of 0° or more and less than 360° with respect to the rolling direction, and a yield strength of 570 MPa or more.

CITATION LIST

Patent Literatures

PTL 1: JP 2015-224384 A
PTL 2: WO 2015129191 A
PTL 3: JP 6057023 B

SUMMARY

Technical Problem

However, for crown caps using the conventional steel sheets for crown cap proposed in PTL 1 to PTL 3 stated above, a sufficient pressure resistance cannot be ensured without expensive soft liners when the steel sheets are subjected to sheet metal thinning, and as a result, costs cannot be reduced. Therefore, the conventional steel sheets for crown cap cannot achieve both an excellent pressure resistance and cost reduction.

It could thus be helpful to provide a steel sheet for crown cap which has excellent formability and from which a crown cap having an excellent pressure resistance can be produced without the use of an expensive soft liner even when the steel sheet is subjected to sheet metal thinning.

Further, it could also be helpful to provide a crown cap produced using the steel sheet for crown cap and a method for producing the steel sheet for crown cap.

Solution to Problem

For solving the problems stated above, the inventors conducted keen study and found the following.

(1) When the internal pressure inside a bottle is increased, a pleated portion crimped to the bottle mouth serves as support to endure deformation of a crown cap, thereby maintaining the sealing inside the bottle. However, as illustrated in FIG. 1B, when a crown cap having a hard liner is crimped to a bottle mouth, the liner is not sufficiently compressed or deformed. Thus, the length of a pleat crimped to the bottle mouth (illustrated by an arrow in FIG. 1B) becomes short compared with the case where a soft liner is used (FIG. 1A). That is, it is conceivable that the reason why the pressure resistance of a crown cap having a hard liner is low is because the length of a pleat crimped to a bottle mouth is short.

(2) Therefore, in order for a crown cap to obtain a sufficient pressure resistance even when using a hard liner, the crown cap is required to be hardly deformed by the increase in the internal pressure in a bottle even if the length of a pleat crimped to the bottle mouth is insufficient.

(3) By optimizing the chemical composition and the production conditions of a steel sheet for crown cap and controlling the dislocation structure at a position of ½ of a sheet thickness so as not to have a low density part, the deformation of a crown cap produced from the steel sheet by the increase in the internal pressure in a bottle can be prevented.

Based on the findings stated above, the inventors conducted further investigation and succeeded in producing a crown cap having excellent formability and an excellent pressure resistance even if the crown cap is thin and has a hard liner, and a steel sheet for such a crown cap. Primary features of this disclosure are as follows.

1. A steel sheet for crown cap having a chemical composition containing (consisting of), in mass %, C: more than 0.006% and 0.012% or less, Si: 0.02% or less, Mn: 0.10% or more and 0.60% or less, P: 0.020% or less, S: 0.020% or less, Al: 0.01% or more and 0.07% or less, and N: 0.0080% or more and 0.0200% or less, with the balance being Fe and inevitable impurities, wherein the steel sheet has a percentage of a region of more than 0% and less than 20% at a position of ½ of a sheet thickness, the region having a dislocation density of $1\times10^{14}$ $m^{-2}$ or less.

2. The steel sheet for crown cap according to 1. having a sheet thickness of 0.20 mm or less.

3. A crown cap obtained by forming the steel sheet for crown cap according to 1. or 2.

4. The crown cap according to 3. comprising a resin liner having an ultra-low loaded hardness of 0.70 or more.

5. A method for producing the steel sheet for crown cap according to 1. or 2. comprising:

hot rolling a steel slab having the chemical composition according to 1., whereby the steel slab is reheated to a slab heating temperature of 1200° C. or higher and subjected to finish rolling to obtain a steel sheet, and then the steel sheet is coiled at a coiling temperature of 670° C. or lower;

after the hot rolling, pickling the steel sheet;

after the pickling, subjecting the steel sheet to primary cold rolling;

after the primary cold rolling, subjecting the steel sheet to continuous annealing at an annealing temperature of 750° C. or lower; and after the continuous annealing, subjecting the steel sheet to secondary cold rolling in an apparatus comprising two or more stands, wherein the secondary cold rolling has a rolling reduction of 10% or more and 30% or less and a rolling rate of 400 mpm or more on the exit side of a final stand.

Advantageous Effect

According to this disclosure, it is possible to provide a steel sheet for crown cap which has excellent formability and from which a crown cap having an excellent pressure resistance can be produced even if the steel sheet is subjected to sheet metal thinning and the crown cap has a hard liner. As a result, even if the steel sheet is subjected to sheet metal thinning, an expensive soft liner is unnecessary, achieving cost reduction as a whole crown cap.

DETAILED DESCRIPTION

Figure 1A:
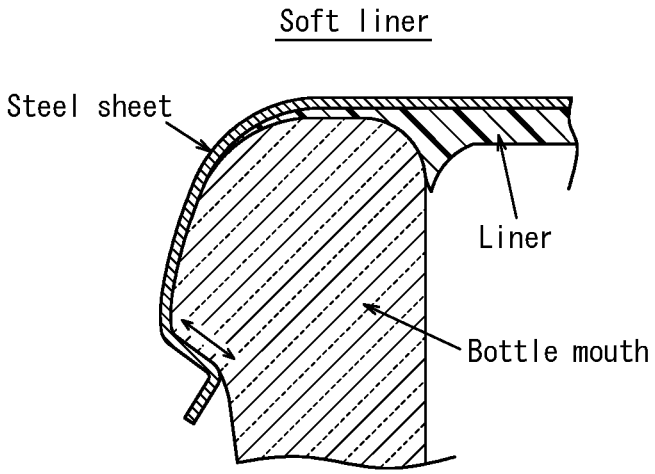
FIG. 1A is a schematic diagram illustrating a cross-sectional shape of a crown cap having a soft liner when the crown cap is crimped to a bottle mouth.
Figure 1B:
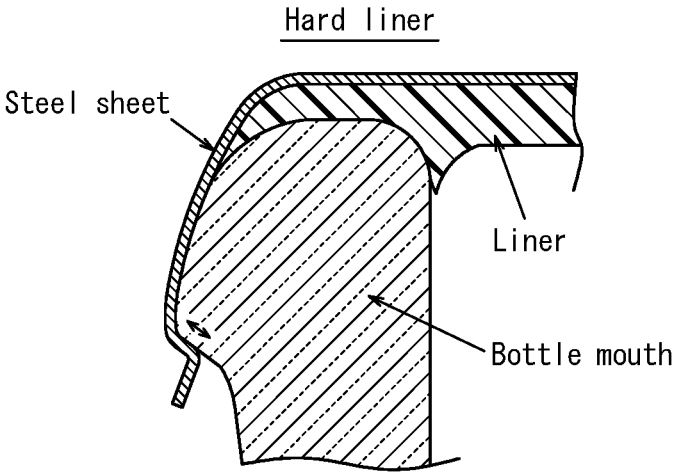
FIG. 1B is a schematic diagram illustrating a cross-sectional shape of a crown cap having a hard liner when the crown cap is crimped to a bottle mouth.

The following describes the present disclosure in detail.

[Chemical Composition]

It is important that a steel sheet for crown cap according to one of the disclosed embodiments has the chemical composition stated above. The reasons for limiting the chemical composition of the steel sheet for crown cap as stated above in this disclosure are described first. In the following description of each chemical component, the unit "%" is "mass %" unless otherwise specified.

C: More than 0.006% and 0.012% or Less

C is an interstitial element and a trace amount of C is added to thereby obtain significant solid solution strengthening by solute C, improving the frictional force of a base steel sheet. Thus, dislocations introduced into a ferrite structure during rolling in a secondary cold rolling step can be pinned to obtain a dislocation substructure in which dislocations densely exist. When the C content is 0.006% or less, a region having a dislocation density of $1\times10^{14}$ $m^{-2}$ or less becomes 20% or more at a position of ½ of a sheet thickness, and thus a pressure resistance of 140 psi (0.965

MPa) or more cannot be obtained without a soft liner. Thus, the C content is set to more than 0.006%. The C content is preferably set to 0.007% or more. On the other hand, when the C content is beyond 0.012%, a region having a dislocation density of $1\times10^{14}$ $m^{-2}$ or less becomes 0%, leading to non-uniform shapes of pleats of a crown cap. Accordingly, the C content is set to 0.012% or less. The C content is preferably set to 0.010% or less.

Si: 0.02% or Less

A Si content beyond 0.02% deteriorates the formability of the steel sheet, leading to non-uniform shapes of pleats of a crown cap, and additionally deteriorating the surface treatability and the corrosion resistance of the steel sheet. Accordingly, the Si content is set to 0.02% or less. Excessively reducing the Si content increases steelmaking costs. Thus, the Si content is preferably set to 0.004% or more.

Mn: 0.10% or More and 0.60% or Less

When the Mn content is less than 0.10%, it is difficult to avoid the hot shortness even if the S content is decreased, causing a problem such as surface cracking during continuous casting. Accordingly, the Mn content is set to 0.10% or more. The Mn content is preferably set to 0.15% or more. On the other hand, a Mn content beyond 0.60% deteriorates the formability of the steel sheet, leading to non-uniform shapes of pleats of a crown cap. Accordingly, the Mn content is set to 0.60% or less. The Mn content is preferably 0.50% or less.

P: 0.020% or Less

The P content beyond 0.020% deteriorates the formability of the steel sheet, leading to non-uniform shapes of pleats of a crown cap, and additionally deteriorating the corrosion resistance. Accordingly, the P content is set to 0.020% or less. Reducing the P content to less than 0.001% excessively increases dephosphorization costs, and thus, the P content is preferably set to 0.001% or more.

S: 0.020% or Less

S, which forms inclusions in the steel sheet, is a harmful element that deteriorates the hot ductility and the corrosion resistance of the steel sheet. Thus, the S content is set to 0.020% or less. Reducing the S content to less than 0.004% excessively increases desulfurization costs, and thus, the S content is preferably set to 0.004% or more.

Al: 0.01% or More and 0.07% or Less

Al is an element necessary as a deoxidizer during steelmaking. When the Al content is less than 0.010%, deoxidation is insufficient to increase inclusions, thus deteriorating the formability of the steel sheet and leading to non-uniform shapes of pleats of a crown cap. Thus, the Al content is set to 0.01% or more. The Al content is preferably set to 0.015% or more. On the other hand, an Al content beyond 0.07% forms a large amount of AlN, decreasing N in the steel, and thus, the following effect of N cannot be obtained. Thus, the Al content is set to 0.07% or less. The Al content is preferably set to 0.065% or less.

N: 0.0080% or More and 0.0200% or Less

N is an interstitial element and as with C, a trace amount of N is added to thereby obtain significant solid solution strengthening by solute N, improving the frictional force of a base steel sheet. Thus, dislocations introduced into a ferrite structure during rolling in the secondary cold rolling step can be pinned to obtain a dislocation substructure in which dislocations densely exist. When the N content is less than 0.0080%, a region having a dislocation density of $1\times10^{14}$ $m^{-2}$ or less is 20% or more at a position of ½ of a sheet thickness, and thus a pressure resistance of 140 psi (0.965 MPa) or more cannot be obtained when a hard liner is used in a crown cap. Thus, the N content is set to 0.0080% or more. The N content is preferably 0.0090% or more. On the other hand, when the N content is beyond 0.0200%, a region having a dislocation density of $1\times10^{14}$ $m^{-2}$ or less becomes 0%, leading to non-uniform shapes of pleats of a crown cap. Thus, the N content is set to 0.0200% or less. The N content is preferably set to 0.0190% or less.

The chemical composition of a steel sheet for crown cap in one of the embodiments may consist of the elements stated above with the balance being Fe and inevitable impurities.

Further, in other embodiments, the chemical composition may arbitrarily contain one or two or more selected from the group consisting of Cu, Ni, Cr, and Mo in a range in which the effect of this disclosure would not be impaired. At that time, the content of each element is preferably set to Cu: 0.2% or less, Ni: 0.15% or less, Cr: 0.10% or less, Mo: 0.05% or less in accordance with ASTM A623M-11. The total contents of elements other than those described above are preferably set to 0.02% or less.

[Dislocation Density]

It is important that the steel sheet for crown cap according to this disclosure has a rate of a region of more than 0% and less than 20% at a position of ½ of a sheet thickness (a position of a depth of ½ of a sheet thickness in the sheet thickness direction from a surface of the steel sheet), the region having a dislocation density of $1\times10^{14}$ $m^{-2}$ or less. In the following description, the "ratio of a region having a dislocation density of $1\times10^{14}$ $m^{-2}$ or less at a position of ½ of a sheet thickness" is conveniently referred to as a "percentage of a low dislocation density region".

When the percentage of a low dislocation density region is less than 20%, a sufficient pressure resistance can be obtained without a soft liner. The reason is not clear, but it is conceivable that dislocations densely exist, and thus non-uniform deformation is suppressed and a crown cap is hardly deformed by the increase the internal pressure in a bottle even if the length of a pleat of the crown cap crimped to a mouth of the bottle is insufficient. It is conceivable that when the percentage of a low dislocation density region is 20% or more, a dislocation part with low density exists, promoting non-uniform deformation, and then, when the length of a pleat of a crown cap crimped to a bottle mouth is insufficient, the crown cap is easily deformed by the increase in the internal pressure in the bottle. Therefore, the percentage of a low dislocation density region is set to less than 20%. The percentage of a low dislocation density region is preferably set to less than 16%. On the other hand, when no low dislocation density region exists and the percentage thereof is 0%, the shapes of pleats of a crown cap become non-uniform. Thus, the percentage of a low dislocation density region is set to more than 0%. The percentage of a low dislocation density region is more preferably set to 4% or more. To set the percentage of a low dislocation density region to more than 0% and less than 20%, a steel raw material having the chemical composition stated above may be subjected to the following production process.

The dislocation structure at a position of ½ of a sheet thickness can be evaluated by observing a thin film sample collected in a manner such that the position of ½ of a sheet thickness is an observation position using a transmission electron microscope (TEM). In the observation, a 5-μm square observation region is randomly selected, the observation region is divided into 25 1-μm square regions, and the dislocation density is determined in each of the 25 regions. Then, among the 25 1-μm square regions, the percentage of the number of regions having a dislocation density of $1\times10^{14}$ $m^{-2}$ or less is defined as the percentage of a low dislocation density region. The dislocation density is determined based on Ham's line intercept method, using photographs taken by TEM. Specifically, assuming that N denotes the number of dislocations intersecting a counting line, L denotes the total length of the counting line, and t denotes the thickness of the sample, the dislocation density p can be calculated by the following formula (1). More specifically, the percentage of a low dislocation density region can be determined by the method described in the following EXAMPLES section.

$$\rho=2N/Lt \quad (1)$$

[Microstructure]

The microstructure of the steel sheet for crown cap of this disclosure is preferably a recrystallized microstructure. This is because when non-recrystallization remains after annealing, material properties of the steel sheet becomes non-uniform, leading to non-uniform shapes of pleats of a crown cap. However, a non-recrystallized microstructure having an area ratio of 5% or less has no significant effect on the shapes of pleats of a crown cap, and thus, the non-recrystallized microstructure preferably has an area ratio of 5% or less.

Further, the crystallized microstructure is preferably a ferrite phase, and the total of the area ratios of microstructures other than the ferrite phase is preferably set to less than 1.0%. In other words, the area ratio of the ferrite phase is preferably set to more than 99.0%.

[Sheet Thickness]

The sheet thickness of the steel sheet for crown cap are not particularly limited and the steel sheet for crown cap may have any thickness. However, from the viewpoint of cost reduction, the sheet thickness is preferably set to 0.20 mm or less, more preferably 0.18 mm or less, and further preferably 0.17 mm or less. A sheet thickness below 0.14 mm is disadvantageous in terms of producing costs. Thus, the lower limit of the sheet thickness is preferably set to 0.14 mm.

A steel sheet for crown cap of one of the embodiments can arbitrarily have at least one of a coating or plating layer, or a coat or film on its one or both surfaces. As the coating or plating layer, any coating or plating film such as a tin coating or plating layer, a chromium coating or plating layer, and a nickel coating or plating layer can be used. Further, as the coat or film, a coat or film of, for example, a print coating, adhesive varnish, and the like can be used.

[Production Method]

The following describes a method for producing a steel sheet for crown cap according to one of the embodiments.

A steel sheet for crown cap according to one of the embodiments can be produced by subjecting a steel slab having the chemical composition as stated above to the following steps (1) to (5) in sequence:

(1) Hot rolling step
(2) Pickling step
(3) Primary cold rolling step
(4) Annealing step
(5) Secondary cold rolling step.

[Steel Slab]

First, steel adjusted to the chemical composition as stated above is prepared by steelmaking using, for example, a converter to produce a steel slab. The method for producing the steel slab is not particularly limited, and the steel slab may be produced by any method such as continuous casting, ingot casting, and thin slab casting. However, the steel slab is preferably produced by continuous casting so as to prevent macro segregation of the components.

The produced steel slab may be cooled to room temperature and subsequently reheated in the next hot-rolling step, but energy-saving processes are applicable without any problem, such as hot direct rolling or direct rolling in which either a warm steel slab without being fully cooled to room temperature is charged into a heating furnace, or a steel slab is hot rolled immediately after being subjected to heat retaining for a short period.

[Hot Rolling Step]

Next, the steel slab is subjected to the hot rolling step. In the hot rolling step, the steel slab is reheated, the reheated steel slab is subjected to hot rolling comprising rough rolling and finish rolling to obtain a hot-rolled steel sheet, and the hot-rolled steel sheet after subjection to the finish rolling is coiled.

(Reheating)

Slab heating temperature: 1200° C. or higher

In the reheating, the steel stab is reheated to a slab heating temperature of 1200° C. or higher. When the slab heating temperature is lower than 1200° C., MN cannot be sufficiently dissolved, and thus solute N cannot be obtained during the following secondary cold rolling step. As a result, the percentage of a low dislocation density region becomes 20% or more, and when a hard liner is used in a crown cap, a pressure resistance of 140 psi (0.965 MPa) or more cannot be obtained. Accordingly, the slab heating temperature is set to 1200° C. or higher. On the other hand, no upper limit is placed on the slab heating temperature, but to decrease the scale loss due to oxidation, the slab heating temperature is preferably set to 1300° C. or lower. To prevent troubles during the hot rolling caused by low slab heating temperature, what is called a sheet bar heater for heating a sheet bar can be used during the hot rolling.

(Finish Rolling)

The finisher delivery temperature during the hot rolling is not particularly limited, but the finisher delivery temperature is preferably set to 850° C. or higher from the viewpoint of the stability of rolling load. On the other hand, unnecessarily increasing the finisher delivery temperature may make it difficult to produce a thin steel sheet. Thus, the finisher delivery temperature is preferably set to 960° C. or lower.

In the hot rolling in this disclosure, at least part of the finish rolling may be conducted as lubrication rolling to reduce a rolling load in the hot rolling. Conducting lubrication rolling is effective from the perspective of making the shape and material properties of the steel sheet uniform. In the lubrication rolling, the friction coefficient is preferably in a range of 0.25 to 0.10. Further, this process is preferably a continuous rolling process in which consecutive sheet bars are joined and continuously subjected to finish rolling. Applying the continuous rolling process is also desirable in view of stable operation of the hot rolling.

(Coiling)

Coiling temperature: 670° C. or lower

When the coiling temperature is beyond 670° C., the amount of MN precipitating in the steel after the coiling is increased and solute N cannot be sufficiently obtained in the following secondary cold rolling step. Thus, the percentage of a low dislocation density region becomes 20% or more, and a pressure resistance of 140 psi (0.965 MPa) or more cannot be obtained without the use of a soft liner in a crown cap. Thus, the coiling temperature is set to 670° C. or lower. The coiling temperature is preferably set to 640° C. or lower. On the other hand, no lower limit is placed on the coiling temperature, but an extremely low coiling temperature increases the strength of the hot-rolled steel sheet to increase the rolling load in the primary cold rolling step, making it difficult to control the primary cold rolling step. Thus, the coiling temperature is preferably set to 500° C. or higher.

[Pickling Step]

Next, the hot-rolled steel sheet after subjection to the hot rolling step is pickled. Oxide scales on a surface of the hot-rolled steel sheet can be removed by the pickling. Pickling conditions are not particularly limited and may be set as appropriate in accordance with a conventional method.

[Primary Cold Rolling Step]

After the pickling, primary cold rolling is performed. The primary cold rolling step is a step in which the pickled sheet after subjection to the pickling step is subjected to cold rolling. Cold rolling conditions in the primary cold rolling step are not particularly limited. For example, from the viewpoint of a desired sheet thickness or the like, conditions such as the rolling reduction may be determined. However, to make the sheet thickness of the steel sheet after subjection to secondary cold rolling 0.20 mm or less, the rolling reduction in the primary cold rolling step is preferably set to 85% to 94%.

[Continuous Annealing Step]

Next, the primary cold-rolled sheet is subjected to continuous annealing. The continuous annealing step is a step in which the cold-rolled steel sheet obtained in the primary cold rolling step is annealed at an annealing temperature of 750° C. or lower. When the annealing temperature is beyond 750° C., C segregates to grain boundaries and coagulates to form carbides and solute C cannot be sufficiently obtained in the secondary cold rolling step. Then, the percentage of a low dislocation density region becomes 20% or more and a pressure resistance of 140 psi (0.965 MPa) or more cannot be obtained without the use of a soft liner in a crown cap. Additionally, a sheet passing failure such as heat buckling easily occurs. Thus, the annealing temperature is set to 750° C. or lower. On the other hand, no lower limit is placed on the annealing temperature, but when the annealing temperature is lower than 650° C., the area ratio of a non-recrystallized microstructure may be beyond 5%, deteriorating the formability. Thus, the annealing temperature is preferably set to 650° C. or higher.

The residence time in a temperature range of 650° C. to 750° C. in the annealing step is not particularly limited but when the residence time is less than 5 seconds, the area ratio of a non-recrystallized microstructure may be beyond 5%. Further, when the residence time is beyond 120 seconds, C segregates to grain boundaries and coagulates to form carbides and thus, solute C cannot be sufficiently obtained in the secondary cold rolling step and additionally costs are increased. Thus, the residence time in the temperature range of 650° C. to 750° C. is preferably set to 5 seconds or more and 120 seconds or less.

[Secondary Cold Rolling Step]

The annealed steel sheet after subjection to the continuous annealing is subjected to secondary cold rolling in an apparatus comprising two or more stands. In the secondary cold rolling step, it is important that the secondary cold rolling step has a rolling reduction of 10% or more and 30% or less and a rolling rate on the exit side of a final stand of 400 mpm or more.

When the rolling rate on the exit side of a final stand is less than 400 mpm, the percentage of a low dislocation density region becomes 20% or more and a pressure resistance of 140 psi (0.965 MPa) or more cannot be obtained without the use of a soft liner in a crown cap. Thus, the rolling rate on the exit side of a final stand is set to 400 mpm or more. The rolling rate is preferably set to 500 mpm or more. On the other side, no upper limit is placed on the rolling rate on the exit side of a final stand and the upper limit may be determined from the viewpoint of operability. For example, the rolling rate may be one at which coiling can be stably performed after the secondary cold rolling step. Specifically, the rolling rate is preferably set to 2000 mpm or less.

When the rolling reduction of the secondary cold rolling is less than 10%, the percentage of a low dislocation density region becomes 20% or more. Thus, the rolling reduction is set to 10% or more. The rolling reduction is preferably set to 12% or more. On the other hand, when the rolling reduction of the secondary cold rolling is beyond 30%, the percentage of a low dislocation density region becomes 0%, leading to non-uniform shapes of pleats of a crown cap. Thus, the rolling reduction is set to 30% or less. The rolling reduction is preferably set to 28% or less.

The apparatus which performs the second cold rolling has a plurality (two or more) of rolling stands. No upper limit is placed on the number of the rolling stands, but providing five or more rolling stands increases apparatus costs. Thus, the number of the rolling stands are preferably set to four or less.

The cold-rolled steel sheet obtained as stated above can be subsequently optionally subjected to coating or plating treatment to obtain a coated or plated steel sheet. The method for the coating or plating treatment is not particularly limited, but electroplating can be used. The coating or plating treatment uses, for example, tin coating or plating, chromium coating or plating, and nickel coating or plating. Further, a coat or film of a print coating, adhesive varnish, and the like can be arbitrarily formed on the cold-rolled steel sheet, or coated or plated steel sheet obtained as stated above. The thickness of the layer subjected to surface treatment such as coating or plating is sufficiently small with respect to the sheet thickness, and thus, the impact on the mechanical properties of the steel sheet is negligible.

[Crown Cap]

A crown cap according to one of the embodiments can be obtained by forming the steel sheet for crown cap. More specifically, the crown cap preferably comprises a metal portion made of the steel sheet for crown cap and a resin liner laminated on the inside of the metal portion. The metal portion includes a disk-shaped portion which covers a bottle mouth and a pleated portion disposed in the periphery thereof. Further, the resin liner is attached to the disk-shaped portion.

The crown cap can be produced by, for example, blanking the steel sheet for crown cap into a circular shape, forming the blank into a crown cap shape by press forming, subsequently providing fused resin to the disk-shaped portion of the crown cap, and further subjecting the crown cap to press forming into a shape easily adhered to a bottle mouth. It is also possible that the steel sheet for crown cap is blanked into a circular shape and formed into a crown cap shape by press forming, and subsequently, resin formed in advance into a shape allowing easy adhesion to a bottle mouth is attached, with an adhesive or the like, to the crown cap.

Resin used for the resin liner is not particularly limited and any resin can be used. For example, the resin is selected from the viewpoint of material costs.

The resin liner preferably has an ultra-low loaded hardness (HTL) of 0.70 or more.

Liners having an ultra-low loaded hardness of 0.70 or more are inexpensive, while liners having an ultra-low loaded hardness of less than 0.70 are expensive. Thus, making the resin liner have an ultra-low loaded hardness of 0.70 or more can reduce the cost of the crown cap. No upper limit is placed on the ultra-low loaded hardness (HTL), but the ultra-low loaded hardness is preferably set to 3.50 or less. Examples of the material of such a hard resin liner include polyolefin, polyvinyl chloride, and polystyrene.

The ultra-low loaded hardness can be measured in accordance with the method described in "JIS Z2255" (2003). In the measurement, a test piece cut out from the crown cap having a resin liner attached to the steel sheet of the crown cap is used. The ultra-low loaded hardness can be calculated by conducting a loading-unloading test using a dynamic microhardness tester and using a test force P (mN) and an obtained maximum indentation depth D (μm) in the following formula (2). More specifically, the ultra-low loaded hardness can be measured by the method described in the EXAMPLES section.

$$HTL=3.858\times P/D^2 \quad (2)$$

The crown cap according to this disclosure assumes an excellent shape after being formed into a crown cap, and has an excellent pressure resistance even when using a hard liner, making it possible to reduce the total cost of the crown cap. Additionally, the amount of waste discharged during use can be reduced.

Examples

Next, a more detailed description is given below based on examples. The following examples merely represent preferred examples, and this disclosure is not limited to these examples.

Steels having the chemical compositions listed in Table 1 were each prepared by steelmaking in a converter and subjected to continuous casting to obtain steel slabs. The obtained steel slabs were subjected to treatments in the hot rolling step, the pickling step, the primary cold rolling step, the continuous annealing step, and the secondary cold rolling step in sequence under conditions listed in Table 2 to produce steel sheets, each having a sheet thickness listed in Table 3. The finisher delivery temperature in the hot rolling step was set to 890° C.

Subsequently, the surfaces of the obtained steel sheets were continuously subjected to usual Cr coating or plating to obtain tin-free steels as steel sheets for crown cap.

TABLE 1

| Steel sample | Chemical composition (in mass %)* | | | | | | | |
|---|---|---|---|---|---|---|---|---|
| ID | C | Si | Mn | P | S | sol. Al | N | Remarks |
| A | 0.0071 | 0.01 | 0.36 | 0.012 | 0.009 | 0.015 | 0.0110 | Example |
| B | 0.0093 | 0.01 | 0.18 | 0.007 | 0.008 | 0.036 | 0.0185 | Example |
| C | 0.0062 | 0.02 | 0.15 | 0.009 | 0.013 | 0.063 | 0.0139 | Example |
| D | 0.0089 | 0.01 | 0.42 | 0.015 | 0.007 | 0.045 | 0.0085 | Example |
| E | 0.0110 | 0.01 | 0.41 | 0.009 | 0.007 | 0.069 | 0.0124 | Example |
| F | 0.0085 | 0.01 | 0.32 | 0.015 | 0.015 | 0.024 | 0.0194 | Example |
| G | 0.0047 | 0.02 | 0.55 | 0.010 | 0.009 | 0.035 | 0.0144 | Comparative Example |
| H | 0.0135 | 0.01 | 0.19 | 0.013 | 0.005 | 0.050 | 0.0102 | Comparative Example |
| I | 0.0078 | 0.01 | 0.28 | 0.008 | 0.008 | 0.041 | 0.0075 | Comparative Example |
| J | 0.0090 | 0.02 | 0.31 | 0.003 | 0.012 | 0.022 | 0.0212 | Comparative Example |
| K | 0.0083 | 0.03 | 0.44 | 0.006 | 0.017 | 0.043 | 0.0122 | Comparative Example |
| L | 0.0098 | 0.02 | 0.63 | 0.011 | 0.015 | 0.033 | 0.0173 | Comparative Example |
| M | 0.0065 | 0.01 | 0.42 | 0.023 | 0.010 | 0.032 | 0.0126 | Comparative Example |
| N | 0.0111 | 0.01 | 0.41 | 0.006 | 0.009 | 0.078 | 0.0132 | Comparative Example |
| O | 0.0096 | 0.01 | 0.33 | 0.009 | 0.007 | 0.005 | 0.0154 | Comparative Example |
| P | 0.0060 | 0.01 | 0.22 | 0.010 | 0.006 | 0.051 | 0.0168 | Comparative Example |

*The balance is Fe and inevitable impurities.

Underlines mean that the corresponding values are outside the range of this disclosure.

TABLE 2

| | | Hot rolling step | | Primary cold rolling step | Continuous annealing step | | Secondary cold rolling step | | | |
|---|---|---|---|---|---|---|---|---|---|---|
| No. | Steel sample ID | Slab heating temperature (° C.) | Coiling temperature (° C.) | Rolling reduction (%) | Annealing temperature (° C.) | Residence time in temperature range of 650° C. to 750° C. (s) | Number of stands | Rolling rate on exit side of final stand (mpm) | Rolling reduction (%) | Remarks |
| 1 | A | 1210 | 530 | 86 | 740 | 30 | 2 | 1200 | 26 | Example |
| 2 | A | 1230 | 610 | 86 | 700 | 15 | 3 | 600 | 14 | Example |
| 3 | A | 1230 | 610 | 86 | 700 | 15 | 3 | 600 | 14 | Example |
| 4 | A | 1230 | 610 | 86 | 680 | 130 | 3 | 1200 | 20 | Example |
| 5 | A | 1230 | 610 | 86 | 690 | 20 | 3 | 1800 | 11 | Example |
| 6 | A | 1195 | 620 | 87 | 660 | 100 | 2 | 500 | 25 | Comparative Example |
| 7 | B | 1225 | 580 | 92 | 650 | 90 | 3 | 700 | 12 | Example |
| 8 | B | 1225 | 630 | 92 | 735 | 80 | 3 | 1500 | 16 | Example |
| 9 | B | 1225 | 630 | 92 | 735 | 80 | 3 | 1500 | 16 | Example |
| 10 | B | 1250 | 660 | 90 | 725 | 55 | 2 | 1700 | 18 | Example |
| 11 | B | 1260 | 620 | 88 | 705 | 40 | 2 | 450 | 20 | Example |
| 12 | B | 1215 | 630 | 90 | 690 | 70 | 2 | 1000 | 40 | Comparative Example |

TABLE 2-continued

| No. | Steel sample ID | Hot rolling step: Slab heating temperature (° C.) | Hot rolling step: Coiling temperature (° C.) | Primary cold rolling step: Rolling reduction (%) | Continuous annealing step: Annealing temperature (° C.) | Continuous annealing step: Residence time in temperature range of 650° C. to 750° C. (s) | Secondary cold rolling step: Number of stands | Secondary cold rolling step: Rolling rate on exit side of final stand (mpm) | Secondary cold rolling step: Rolling reduction (%) | Remarks |
|---|---|---|---|---|---|---|---|---|---|---|
| 13 | B | 1205 | 700 | 92 | 690 | 10 | 2 | 900 | 28 | Comparative Example |
| 14 | C | 1220 | 550 | 87 | 655 | 10 | 3 | 800 | 30 | Example |
| 15 | C | 1220 | 550 | 87 | 655 | 10 | 3 | 800 | 30 | Example |
| 16 | C | 1240 | 520 | 87 | 750 | 15 | 2 | 1600 | 25 | Example |
| 17 | C | 1230 | 600 | 91 | 730 | 20 | 2 | 600 | 22 | Example |
| 18 | C | 1205 | 610 | 89 | 720 | 30 | 2 | 1600 | 24 | Example |
| 19 | C | 1240 | 620 | 90 | 700 | 25 | 2 | 300 | 19 | Comparative Example |
| 20 | D | 1245 | 610 | 93 | 690 | 50 | 3 | 1000 | 17 | Example |
| 21 | D | 1245 | 610 | 93 | 690 | 50 | 3 | 1000 | 17 | Example |
| 22 | D | 1245 | 615 | 85 | 720 | 50 | 4 | 500 | 23 | Example |
| 23 | D | 1250 | 625 | 94 | 740 | 55 | 4 | 800 | 26 | Example |
| 24 | D | 1200 | 615 | 89 | 770 | 65 | 2 | 600 | 27 | Comparative Example |
| 25 | E | 1210 | 615 | 89 | 700 | 90 | 3 | 700 | 13 | Example |
| 26 | E | 1210 | 615 | 89 | 700 | 90 | 3 | 700 | 13 | Example |
| 27 | E | 1200 | 650 | 90 | 670 | 110 | 2 | 1900 | 18 | Example |
| 28 | E | 1215 | 570 | 90 | 660 | 60 | 3 | 1700 | 5 | Comparative Example |
| 29 | F | 1220 | 605 | 88 | 710 | 120 | 3 | 1500 | 28 | Example |
| 30 | F | 1220 | 605 | 88 | 710 | 120 | 3 | 1500 | 28 | Example |
| 31 | F | 1235 | 565 | 86 | 715 | 100 | 2 | 1500 | 24 | Example |
| 32 | F | 1235 | 590 | 85 | 720 | 50 | 2 | 1300 | 20 | Example |
| 33 | G | 1220 | 600 | 90 | 680 | 25 | 2 | 1000 | 19 | Comparative Example |
| 34 | H | 1230 | 570 | 93 | 690 | 20 | 2 | 900 | 17 | Comparative Example |
| 35 | I | 1230 | 570 | 92 | 690 | 30 | 2 | 1000 | 15 | Comparative Example |
| 36 | J | 1230 | 600 | 91 | 700 | 35 | 2 | 800 | 13 | Comparative Example |
| 37 | K | 1220 | 600 | 88 | 690 | 15 | 2 | 800 | 12 | Comparative Example |
| 38 | L | 1225 | 590 | 89 | 690 | 15 | 2 | 600 | 21 | Comparative Example |
| 39 | M | 1220 | 600 | 88 | 670 | 20 | 2 | 600 | 22 | Comparative Example |
| 40 | N | 1280 | 660 | 89 | 670 | 80 | 2 | 1200 | 24 | Comparative Example |
| 41 | O | 1270 | 640 | 92 | 660 | 60 | 2 | 1100 | 25 | Comparative Example |
| 42 | P | 1260 | 620 | 94 | 700 | 40 | 2 | 600 | 21 | Comparative Example |

* Underlines mean that the corresponding values are outside the range of this disclosure.

(Percentage of Low Dislocation Density Region)

Next, the ratio of a region having a dislocation density of $1\times10^{14}$ $m^{-2}$ or less (percentage of a low dislocation density region) was measured by the following procedures at a position of ½ of a sheet thickness of each obtained steel sheet.

First, a thin film sample for TEM observation was made from each steel sheet for crown cap so that a position of ½ of a sheet thickness is an observation position. The thin film sample was prepared by equally subjecting the both sides of the steel sheet to mechanical polishing to reduce the thickness of the steel sheet into 50 μm and subsequently subjecting the steel sheet to twin-jet electropolishing. The obtained thin film sample was bored to form a hole and the dislocation structure in the periphery of the hole was observed with TEM. At that time, the accelerating voltage was set to 200 kV.

In the observation, a 5-μm square observation region was randomly selected, the observation region was divided into 25 1-μm square regions, and the dislocation density was determined in each of the 25 regions. Then, among the 25 1-μm square regions, the percentage of the number of regions having a dislocation density of $1\times10^{14}$ $m^{-2}$ or less was defined as the percentage of a low dislocation density region. The dislocation density was determined based on the Ham's line intercept method, using the images taken by TEM at 5000 times magnification. Specifically, assuming that N denotes the number of dislocations intersecting a counting line, L denotes the total length of a counting line, and t denotes the thickness of the sample, the dislocation density p can be calculated by the following formula (1). A lattice of 20×20 (the length of one counting line: 1 μm) was used to count dislocations, and thus L was set to 40 μm and t was set to 0.1 μm.

$$\rho=2N/Lt \quad (1)$$

(Formability)

Further, the obtained steel sheets for crown cap were subjected to heat treatment corresponding to paint baking at 210° C. for 15 minutes and then formed into crown caps by the following procedures, and the formability of the steel sheets for crown cap was evaluated.

First, each steel sheet for crown cap was punched to prepare a circular blank having a diameter of 37 mm. The circular blank was formed by press working into a size of a type-3 crown cap (an outer diameter of 32.1 mm, a height of 6.5 mm, and the number of pleats of 21) specified in "JIS S9017" (1957). Formability was evaluated by visual inspection. Specifically, when the shapes of pleats of the obtained crown cap were uniform, the crown cap was judged as satisfactory (good) and when the shapes of pleats of the obtained crown cap were non-uniform, the crown cap was judged as unsatisfactory (poor). When the evaluation result of the formability was unsatisfactory (poor), the corresponding crown cap was not subjected to the following pressure test.

Resin liners of differing hardness were attached to the inside of the disk-shaped portions of the formed crown caps to prepare crown caps comprising the resin liners. On each obtained crown cap, the pressure resistance and the ultra-low loaded hardness of the liner were evaluated by the following procedures.

(Pressure Resistance)

Each crown cap was put on a commercially available bottle, subsequently a hole having a small diameter was opened on the top of the crown cap, and an instrument for providing air into the bottle was mounted. The instrument was used to inject air into the bottle at a rate of 5 psi (0.034 MPa)/s to increase the internal pressure in the bottle to 155 psi (1.069 MPa) and the internal pressure was held at 155 psi (1.069 MPa) for 1 minute. When the crown cap was detached from the bottle mouth or the leakage was caused during the increase in the internal pressure or the holding of the internal pressure, a corresponding pressure was recorded as a pressure resistance. When the crown cap was not detached from the bottle mouth until the end of the holding time for 1 minute, 155 psi (1.069 MPa) was recorded as a pressure resistance. When the recorded pressure resistance was 155 psi (1.069 MPa), the crown cap was judged as excellent. When the recorded pressure resistance was 140 psi (0.968 MPa) or more and less than 155 psi (1.069 MPa), the crown cap was judged as good. When the recorded pressure resistance was less than 140 psi (0.965 MPa), the crown cap was judged as poor.

(Ultra-Low Loaded Hardness)

The ultra-low loaded hardness of each liner was measured in accordance with the method described in "JIS Z 2255" (2003). In the measurement, a test piece cut out from each crown cap having a resin liner attached to the steel sheet of the crown cap was used. The steel sheet side of the leveled test piece was fixed by adhesion with epoxy resin, and a loading-unloading test was conducted using a dynamic microhardness tester (DUH-W201S, Shimadzu Corporation) to measure the ultra-low loaded hardness.

The measurement conditions were a test force P of 0.500 mN, a loading rate of 0.142 mN/s, a holding time of 5 seconds, a temperature of 23±2° C., and a humidity of 50±5%. A triangular pyramid-shaped diamond indenter having a vertex angle of 115° was used. The ultra-low loaded hardness HTL was calculated from the following formula (2) using the test force P (mN) and an obtained maximum indentation depth D (μm). Measurement was conducted at 10 points and the arithmetic mean value of the results was defined as the ultra-low loaded hardness of the liner.

$$HTL=3.858\times P/D^2 \quad (2)$$

(Costs)

A crown cap cost less than the cost of a conventional crown was judged as excellent and a crown cap cost equivalent to the cost of a conventional crown was judged as good.

TABLE 3

| | | | Steel sheet for crown cap | | Crown cap | | | |
|---|---|---|---|---|---|---|---|---|
| No. | Steel sample ID | Sheet thickness (mm) | Ratio of low dislocation density region (%) | Formability | Ultra-low loaded hardness of liner | Pressure resistance | Cost | Remarks |
| 1 | A | 0.20 | 12 | Good | 1.06 | Excellent | Excellent | Example |
| 2 | A | 0.17 | 8 | Good | 2.34 | Excellent | Excellent | Example |
| 3 | A | 0.15 | 8 | Good | 0.11 | Excellent | Good | Example |
| 4 | A | 0.15 | 16 | Good | 1.21 | Good | Excellent | Example |
| 5 | A | 0.18 | 16 | Good | 0.83 | Good | Excellent | Example |
| 6 | A | 0.17 | 20 | Good | 0.99 | Poor | Excellent | Comparative Example |
| 7 | B | 0.19 | 4 | Good | 1.26 | Excellent | Excellent | Example |
| 8 | B | 0.15 | 4 | Good | 0.73 | Excellent | Excellent | Example |
| 9 | B | 0.15 | 4 | Good | 0.51 | Excellent | Good | Example |
| 10 | B | 0.18 | 16 | Good | 0.81 | Good | Excellent | Example |
| 11 | B | 0.17 | 16 | Good | 0.90 | Good | Excellent | Example |
| 12 | B | 0.19 | 0 | Poor | 0.72 | — | Excellent | Comparative Example |
| 13 | B | 0.17 | 28 | Good | 1.01 | Poor | Excellent | Comparative Example |
| 14 | C | 0.18 | 16 | Good | 1.23 | Good | Excellent | Example |
| 15 | C | 0.16 | 16 | Good | 0.42 | Excellent | Good | Example |
| 16 | C | 0.15 | 16 | Good | 1.93 | Good | Excellent | Example |
| 17 | C | 0.18 | 16 | Good | 0.77 | Good | Excellent | Example |
| 18 | C | 0.21 | 12 | Good | 0.83 | Excellent | Good | Example |
| 19 | C | 0.17 | 24 | Good | 0.79 | Poor | Excellent | Comparative Example |
| 20 | D | 0.17 | 16 | Good | 0.80 | Good | Excellent | Example |
| 21 | D | 0.18 | 16 | Good | 0.31 | Excellent | Good | Example |
| 22 | D | 0.15 | 16 | Good | 0.99 | Good | Excellent | Example |
| 23 | D | 0.19 | 16 | Good | 1.52 | Good | Excellent | Example |
| 24 | D | 0.17 | 20 | Good | 1.55 | Poor | Excellent | Comparative Example |
| 25 | E | 0.18 | 4 | Good | 3.16 | Excellent | Excellent | Example |
| 26 | E | 0.16 | 4 | Good | 0.63 | Excellent | Good | Example |
| 27 | E | 0.17 | 16 | Good | 2.22 | Good | Excellent | Example |
| 28 | E | 0.15 | 32 | Good | 1.13 | Poor | Excellent | Comparative Example |

TABLE 3-continued

| No. | Steel sample ID | Sheet thickness (mm) | Steel sheet for crown cap: Ratio of low dislocation density region (%) | Formability | Crown cap: Ultra-low loaded hardness of liner | Pressure resistance | Cost | Remarks |
|---|---|---|---|---|---|---|---|---|
| 29 | F | 0.19 | 4 | Good | 0.87 | Excellent | Excellent | Example |
| 30 | F | 0.18 | 4 | Good | 0.06 | Excellent | Good | Example |
| 31 | F | 0.15 | 4 | Good | 1.33 | Excellent | Excellent | Example |
| 32 | F | 0.18 | 12 | Good | 0.78 | Excellent | Excellent | Example |
| 33 | G | 0.17 | 28 | Good | 0.82 | Poor | Excellent | Comparative Example |
| 34 | H | 0.18 | 4 | Poor | 0.98 | — | Excellent | Comparative Example |
| 35 | I | 0.18 | 20 | Good | 0.93 | Poor | Excellent | Comparative Example |
| 36 | J | 0.19 | 4 | Poor | 1.84 | — | Excellent | Comparative Example |
| 37 | K | 0.16 | 4 | Poor | 1.22 | — | Excellent | Comparative Example |
| 38 | L | 0.19 | 4 | Poor | 1.66 | — | Excellent | Comparative Example |
| 39 | M | 0.17 | 4 | Poor | 1.34 | — | Excellent | Comparative Example |
| 40 | N | 0.17 | 24 | Good | 1.00 | Poor | Excellent | Comparative Example |
| 41 | O | 0.18 | 8 | Poor | 0.93 | — | Excellent | Comparative Example |
| 42 | P | 0.18 | 24 | Good | 0.81 | Poor | Excellent | Comparative Example |

* Underlines mean that the corresponding values are outside the range of this disclosure.

The evaluation results of each item are listed in Table 3. As seen from the results, the steel sheets for crown cap satisfying the requirements of this disclosure had excellent formability and the crown caps produced therefrom had an excellent pressure resistance of 140 psi (0.965 MPa) or more even when the liners of the crown caps had an ultra-low loaded hardness of 0.70 or more.

Although a crown cap with a liner having an ultra-low loaded hardness of less than 0.70 also exhibited an excellent pressure resistance, a liner having an ultra-low loaded hardness of less than 0.70 is expensive. Thus, a liner having an ultra-low loaded hardness of 0.70 or more is preferably used in terms of the cost of a whole crown cap.

Further, the steel sheets for crown cap satisfying the requirements of claim 1 and having a sheet thickness of more than 0.20 mm had excellent formability and the crown caps produced therefrom had an excellent pressure resistance of 140 psi (0.965 MPa) or more even when the liners of the crown caps had an ultra-low loaded hardness of 0.70 or more. However, in such crown caps, the cost reduction by sheet metal thinning cannot be obtained. Thus, the steel sheet for crown cap preferably has a sheet thickness of 0.20 mm or less in terms of the cost of a whole crown cap.

On the other hand, steel sheets for crown cap failing to satisfy the requirements of this disclosure (as in comparative examples) were inferior in at least one of the formability or the ultra-low loaded hardness of crown caps produced from the steel sheets when the liners of the crown caps each had an ultra-low loaded hardness of 0.70 or more. Although crown caps formed from steel sheets of comparative examples may also have an excellent pressure resistance when the liners of the crown caps have an ultra-low loaded hardness of less than 0.70, the liners having an ultra-low loaded hardness of less than 0.70 are expensive, and thus, such crown caps are inferior in terms of cost.

For the steel sheet of No. 6, the slab heating temperature in the hot rolling step was less than 1200° C., which was outside the range of this disclosure, and the percentage of a low dislocation density region was 20% or more, which was outside the range of this disclosure. Thus, the corresponding crown cap had a poor pressure resistance.

The steel sheet of No. 9 was a steel sheet within the scope of this disclosure and the corresponding crown cap exhibited excellent formability and pressure resistance. However, the liner had an ultra-low loaded hardness of less than 0.70, and thus, the crown cap as a whole was inferior in terms of cost.

For the steel sheet of No. 12, the rolling reduction in the secondary cold rolling step was more than 30%, which was outside the range of this disclosure, and the percentage of a low dislocation density region was 0%, which was outside the range of this disclosure. Thus, the steel sheet of No. 12 had poor formability.

For the steel sheet of No. 13, the coiling temperature in the hot rolling step was more than 670° C., which was outside the range of this disclosure, and the percentage of a low dislocation density region was 20% or more, which was outside the range of this disclosure. Thus, the corresponding crown cap had a poor pressure resistance.

The steel sheet of No. 15 was a steel sheet within the scope of this disclosure and the corresponding crown cap exhibited excellent formability and pressure resistance, but the liner had an ultra-low loaded hardness of less than 0.70. Thus, the crown cap as a whole was inferior in terms of cost.

The steel sheet of No. 18 was a steel sheet within the scope of this disclosure and the corresponding crown cap exhibited excellent formability and pressure resistance, but the sheet thickness was more than 0.20 mm. Thus, the crown cap as a whole was inferior in terms of cost.

For the steel sheet of No. 19, the rolling rate on the exit side of a final stand in the secondary cold rolling step was less than 400 mpm, which was outside the range of this disclosure, and the percentage of a low dislocation density region was 20% or more, which was outside the range of this disclosure. Thus, the corresponding crown cap had a poor pressure resi stance.

The steel sheet of No. 21 was a steel sheet within the scope of this disclosure and the corresponding crown cap exhibited excellent formability and pressure resistance, but the liner had an ultra-low loaded hardness of less than 0.70. Thus, the crown cap as a whole was inferior in terms of cost.

For the steel sheet of No. 24, the annealing temperature in the annealing step was more than 750° C., which was outside the range of this disclosure, and the percentage of a low dislocation density region was 20% or more, which was outside the range of this disclosure. Thus, the corresponding crown cap had a poor pressure resistance.

The steel sheet of No. 26 was a steel sheet within the scope of this disclosure and the corresponding crown cap exhibited excellent formability and pressure resistance, but the liner had an ultra-low loaded hardness of less than 0.70. Thus, the crown cap as a whole was inferior in terms of cost.

For the steel sheet of No. 28, the rolling reduction in the secondary cold rolling step was less than 10% and the percentage of a low dislocation density region was 20% or more, which was outside the range of this disclosure. Thus, the corresponding crown cap had a poor pressure resistance.

The steel sheet of No. 30 was a steel sheet within the scope of this disclosure and the corresponding crown cap exhibited excellent formability and pressure resistance, but the liner had an ultra-low loaded hardness of less than 0.70. Thus, the crown cap as a whole was inferior in terms of cost.

For the steel sheet of No. 33, the C content was 0.006% or less and the percentage of a low dislocation density region was 20% or more, which was outside the range of this disclosure. Thus, the corresponding crown cap had a poor pressure resistance.

The steel sheet of No. 34, which had a C content of more than 0.012%, had poor formability.

For the steel sheet of No. 35, the N content was less than 0.0080% and the percentage of a low dislocation density region was 20% or more, which was outside the range of this disclosure. Thus, the corresponding crown cap had a poor pressure resistance.

The steel sheet of No. 36, which had a N content of more than 0.0200%, had poor formability.

The steel sheet of No. 37, which had a Si content of more than 0.02%, had poor formability.

The steel sheet of No. 38, which had a Mn content of more than 0.60%, had poor formability.

The steel sheet of No. 39, which had a P content of more than 0.020%, had poor formability.

For the steel sheet of No. 40, the Al content was more than 0.07% and the percentage of a low dislocation density region was 20% or more, which was outside the range of this disclosure. Thus, the corresponding crown cap had a poor pressure resistance.

The steel sheet of No. 41, which had an Al content of less than 0.01%, had poor formability.

For the steel sheet of No. 42, the C content was 0.0060 or less and the percentage of a low dislocation density region was 20% or more, which was outside the range of this disclosure. Thus, the corresponding crown cap had a poor pressure resistance.

The invention claimed is:

1. A steel sheet for crown cap having a chemical composition containing, in mass %, C: more than 0.006% and 0.012% or less, Si: 0.02% or less, Mn: 0.10% or more and 0.60% or less, P: 0.020% or less, S: 0.020% or less, Al: 0.01% or more and 0.07% or less, and N: 0.0080% or more and 0.0200% or less, with the balance being Fe and inevitable impurities, wherein the steel sheet has a percentage of a region of more than 0% and less than 20% at a position of ½ of a thickness of the steel sheet, the region having a dislocation density of $1\times10^{14}$ $m^{-2}$ or less.

2. The steel sheet for crown cap according to claim 1, wherein the thickness of the steel sheet is 0.20 mm or less.

3. A crown cap made of the steel sheet for crown cap according to claim 1.

4. The crown cap according to claim 3 comprising a resin liner having an ultra-low loaded hardness of 0.70 or more.

5. A method for producing the steel sheet for crown cap according to claim 1 comprising:

hot rolling a steel slab having the chemical composition according to claim 1, whereby the steel slab is reheated to a slab heating temperature of 1200° C. or higher and subjected to finish rolling to obtain a steel sheet, and then the steel sheet is coiled at a coiling temperature of 670° C. or lower;

after the hot rolling, pickling the steel sheet;

after the pickling, subjecting the steel sheet to primary cold rolling;

after the primary cold rolling, subjecting the steel sheet to continuous annealing at an annealing temperature of 750° C. or lower; and after the continuous annealing, subjecting the steel sheet to secondary cold rolling in an apparatus comprising two or more stands, wherein the secondary cold rolling has a rolling reduction of 10% or more and 30% or less and a rolling rate of 400 mpm or more on the exit side of a final stand.

6. A crown cap made of the steel sheet for crown cap according to claim 2.

7. A method for producing the steel sheet for crown cap according to claim 2 comprising:

hot rolling a steel slab having the chemical composition according to claim 1, whereby the steel slab is reheated to a slab heating temperature of 1200° C. or higher and subjected to finish rolling to obtain a steel sheet, and then the steel sheet is coiled at a coiling temperature of 670° C. or lower;

after the hot rolling, pickling the steel sheet;

after the pickling, subjecting the steel sheet to primary cold rolling;

after the primary cold rolling, subjecting the steel sheet to continuous annealing at an annealing temperature of 750° C. or lower; and after the continuous annealing, subjecting the steel sheet to secondary cold rolling in an apparatus comprising two or more stands, wherein the secondary cold rolling has a rolling reduction of 10% or more and 30% or less and a rolling rate of 400 mpm or more on the exit side of a final stand.

* * * * *